United States Patent [19]

Miyasaka et al.

[11] Patent Number: 4,861,395

[45] Date of Patent: Aug. 29, 1989

[54] METHOD OF USING MACHINE PARTS MADE OF AUSTENITIC CAST IRON HAVING RESISTANCE TO STRESS CORROSION CRACKING IN CONTACT WITH SALT WATER

[75] Inventors: Matsuho Miyasaka, Yokohama; Katsuhiro Ichikawa, Zama; Katsumi Sasaki, Tokyo; Syotaro Mizobuchi, Ebina; Naoaki Ogure, Tokyo, all of Japan

[73] Assignee: Ebara Corporation, Tokyo, Japan

[21] Appl. No.: 745,624

[22] Filed: Jun. 17, 1985

[30] Foreign Application Priority Data

Jun. 22, 1984 [JP] Japan ..... 59-127632

[51] Int. Cl.[4] ..... C22C 38/36

[52] U.S. Cl. ..... 148/321; 420/9; 420/16; 417/DIG. 1

[58] Field of Search ..... 75/128 D; 148/35, 321-324; 420/9, 13, 15, 16; 417/DIG. 1

[56] References Cited

U.S. PATENT DOCUMENTS

| | | | |
|---|---|---|---|
| 1,626,248 | 9/1925 | Merica et al. | 75/128 D |
| 2,326,730 | 8/1943 | Kelly et al. | 75/128 D |
| 2,485,760 | 10/1949 | Millis et al. | 148/321 |
| 3,004,905 | 10/1961 | Sabins | 204/147 |
| 3,485,683 | 12/1969 | Schelleng et al. | 148/321 |
| 4,116,782 | 9/1978 | Bon | 204/196 |
| 4,152,236 | 5/1979 | Beese | 204/197 |
| 4,169,028 | 9/1979 | Yokoyama et al. | 204/196 |
| 4,528,045 | 7/1985 | Tanaka et al. | 75/128 D |

FOREIGN PATENT DOCUMENTS

| | | | |
|---|---|---|---|
| 2144834 | 3/1973 | Fed. Rep. of Germany . | |
| 136218 | 10/1975 | Japan . | |
| 52315 | 5/1976 | Japan . | |
| 52-4419 | 1/1977 | Japan | 420/9 |
| 88529 | 7/1977 | Japan . | |
| 51550 | 5/1981 | Japan . | |
| 116852 | 9/1981 | Japan . | |
| 161047 | 10/1982 | Japan . | |
| 71353 | 4/1983 | Japan . | |
| 80751 | 5/1984 | Japan . | |

OTHER PUBLICATIONS

Ni-Resist Irons for Pumps in Corrosion Resisting Applications, Chemical Engineering, World, vol. XV, No. 3, pp. 43-59, (1980).

Materials for Seawater and Brine Recycle Pumps, (INCO).

"Guidelines for Selection of Marine Materials," INCO, (1971), pp. 3-38.

Engineering Properties and Applicants of the Ni-Resists and Ductile Ni-Resists, (INCO), p. 10.

E. H. Phelps: Proc. Conf. Fundamental Aspects of Stress Corrosion Cracking, NACE, pp. 398-410, (1967).

Werkstoffe und Korrosion, vol. 31, No. 12, Dec. 1980, p. 953, No. 80-8563, Weinheim, DE; A. I. Kovalenko.

Miyasaka et al., "Stress Corrosion Cracking of Austenitic Cast Irons in Seawater and Brine, and Its Prevention," Corrosion '86, (The International Corrosion Forum), Mar. 1986, Paper No. 324, 7 pages.

(List continued on next page.)

*Primary Examiner*—Deborah Yee

*Attorney, Agent, or Firm*—Frishauf, Holtz, Goodman & Woodward

[57] ABSTRACT

Austenitic cast iron has excellent corrosion resisting properties and has been preferentially used in machines or machine parts intended for handling corrosive fluids such as seawater. Cases, however, have been reported of machines or machine parts made of austenitic cast iron failing after they had been put to prolonged service at relatively low temperatures. The present inventors have located stress corrosion cracking at the cause of this failure.

In accordance with the present invention, methods of using salt water resisting machines or machine parts made of austenitic cast iron that has graphite in the form of spheroids or nodules and which comprises by weight %: C≦3.0, Si=1.0−3.0, Mn≦1.5, P≦0.08, Ni>2-4-28%, Cr≦5.5 and the balance being Fe to minimize stress corrosion are provided.

3 Claims, 2 Drawing Sheets

OTHER PUBLICATIONS

Kinoshita et al., "Corrosion of Several Materials for Pump in Flowing Water Containing Chloride Ion," Boshoku Gijutsu, (Corrosion Engineering Technology), 32, (1983), pp. 31–32, (English Abstract).

Chem. Abstracts, vol. 97, p. 249, 10162w.

Applegate, Cathodic Protection, 1960, pp. 23–26, 166–168, 195.

Proc. Conf. Fundamental Aspects of Stress Corrosion Cracking, NACE, pp. 226–241, 1967.

Nippon Zairyo Gakkai, pp. 24–29, 1978.

Shinpan Tekko Gijutsu Koza, (New Edition of Iron and Steel Techology Course), No. 5, "Haganeimono--Chutetsuimono", (Steel Castings–Cast Iron Castings), published by Chijin Shokan K.K., (May 30, 1979), pp. 322–323.

Einführung in Die Din–Normen Von Obering, Martin Klein, Berlin Herausgegeben vom Deutschen Normenausschlus Sechste, Neubearbeitete und Erweiterte Auflage, 1970, B. G. Teubner–Stuttgart.

METHOD OF USING MACHINE PARTS MADE OF AUSTENITIC CAST IRON HAVING RESISTANCE TO STRESS CORROSION CRACKING IN CONTACT WITH SALT WATER

BACKGROUND OF THE INVENTION

The present invention relates to salt water resisting machines or machine parts made of austenitic cast iron having resistance to stress corrosion cracking in salt water which contains chloride ion ($Cl^-$) such as natural seawater, concentrated seawater or diluted seawater.

Austenitic cast iron, i.e., ASTM A-436 of the flaky graphite type or ASTM A-439 of the nodular graphite type, containing 13.5–22 wt % or 28–37 wt % of Ni (all percents noted hereinafter are by weight) exhibits good corrosion resistance or good heat resistance and is preferentially used in machines or machine parts intended for use under corrosive environments associated with the handling of salt water and the like, or under high temperature environments.

While various species of austenitic cast iron are known, austenitic cast iron containing 13.5–22 wt % of Ni, i.e., ASTM A-436 Type 1, Type 1b, Type 2, Type 2b, ASTM A-439 Type D-2 or Type D-2B, is used in machines or machine parts intended for use in salt water, and austenitic cast iron containing more than 28% Ni is used in equipment at chemical plants which is required to have high heat resisting properties. Austenitic cast iron with a nickel content of 22% or below provides sufficient corrosion resistance for machines or machine parts intended for use in salt water. Because of this fact and the economical advantage resulting from low nickel content, in no case has austenitic cast iron with a nickel content of 28% or higher been used as a material for machines or machine parts intended for use in salt water.

Austenitic cast iron species are available that contain up to 24% of nickel and have an increased Mn content, and Type D-2C is an example of such species. However, they are exclusively used as materials for machines or machine parts intended for use at cryogenic temperatures, and in no case have they been used in corrosion-resistant machines or machine parts intended for use in salt water.

The resistance of austenitic cast iron to general corrosion is such that the corrosion rate is only about 0.1 mm/year in seawater at ordinary temperatures. Unlike mild steels and cast iron, the increase in the rate of general corrosion in austenitic cast iron situated in flowing seawater over that in standing seawater is negligible, and if the seawater flows faster, the rate of corrosion is even seen to decrease. Additionally, austenitic cast iron is not susceptible to localized corrosion such as crevice corrosion and pitting corrosion that are common to stainless steel. Because of the balanced resistance to various forms of corrosion, austenitic cast iron is extensively used in machines and machine parts that handle seawater and other corrosive fluids.

Cases, however, have been reported to the assignee of the present invention of machines or machine parts made of austenitic cast iron handling natural seawater or concentrated seawater developing cracks a considerable time after the start of service.

SUMMARY OF THE INVENTION

An object of the present invention resides in providing a salt water resisting machine or machine part made of austenitic cast iron having a specified alloy composition.

The seawater resisting machine or machine part according to the present invention is made of austenitic cast iron that has graphite in the form of spheroids or nodules and which has the following composition (by weight %):

| | |
|---|---|
| C | ≦3.00 |
| Si | 1.00–3.00 |
| Mn | ≦1.5 |
| P | ≦0.08 |
| Ni | 24.28 |
| Cr | ≦5.5 |
| Fe | balance. |

DETAILED DESCRIPTION OF THE INVENTION

Figure 1:
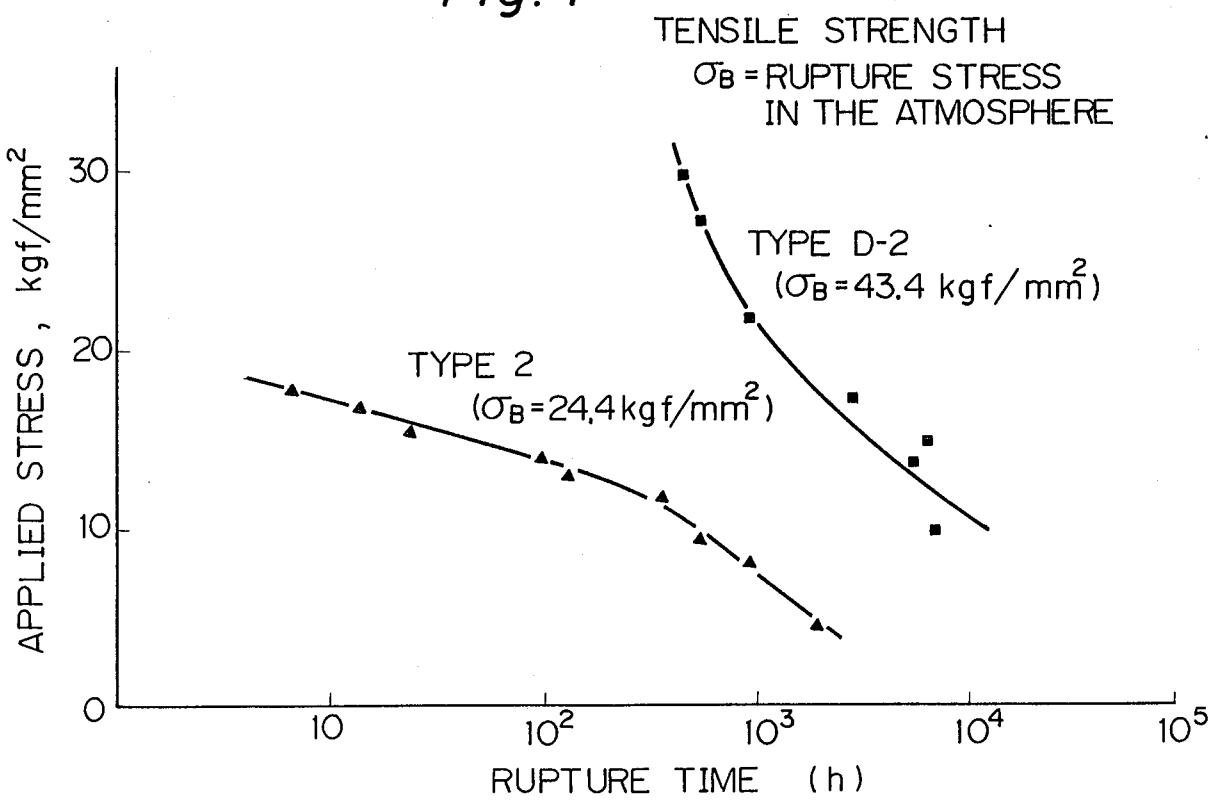
FIG. 1 shows applied stress vs. rupture time characteristic curves for austenitic cast iron species, Type 2 and Type D-2, submerged in 7% NaCl solution at 33° C.

The present inventors made various studies to unravel the behavior of austenitic cast iron in relation to its failure in natural seawater or concentrated seawater. As a result, the inventors have discovered that such failure is caused by stress corrosion cracking (hereunder abbreviated to SCC).

There are no reported cases of SCC occurring in austenitic cast iron used in salt water in the vicinity of ordinary temperatures. The occurrence of SCC in boiling 42% $MgCl_2$, boiling 20% NaCl and NaOH at 90% of the yield stress has been reported in Engineering Properties and Applications of the Ni-Resists and Ductile Ni-Resists (INCO). The general understanding has been that austenitic cast iron has high SCC resistance in a chloride environment. Alloys having the austenitic structure such as Cr-Ni austenitic stainless steel are well known to be susceptible to SCC in chloride solutions, but very few cases have been reported on the occurrence of SCC at temperatures lower than 50° C. SCC may occur at ordinary temperatures as a result of hydrogen embrittlement, but the susceptibility of the austenitic structure to hydrogen embrittlement is low.

In order to check for the possibility of the occurrence of SCC in austenitic cast iron, the present inventors made the following SCC test. The chemical composition of each of the test specimens and their tensile strength (rupture stress in the atmosphere) are shown in Table 1. The same test was conducted on four samples of ferritic cast iron and one sample of austenitic stainless steel.

All samples of the austenitic cast iron had been annealed (heating at 635° C. for 5 hours followed by furnace cooling) in order to relieve any residual stress. The constant load tension test was conducted by applying varying stresses to a test piece (5 mmϕ) submerged in 7% NaCl at 33° C. The two samples of Type 2 and Type D-2 were also tested in 3% NaCl, 1% NaCl and natural seawater at 25° C. by applying 80% of the tensile strength of the respective samples. The results are shown in Table 2.

TABLE 1

| | Materials | SCC Test Materials Chemical composition wt % C | Si | Mn | P | S | Cr | Ni | Cu | Mo | Tensile strength |
|---|---|---|---|---|---|---|---|---|---|---|---|
| Austenitic cast iron | ASTM A436 Type 1 | 2.50 | 1.58 | 1.65 | — | 0.018 | 2.13 | 15.47 | 5.93 | — | 24.2 |
| | ASTM A436 Type 2 | 2.66 | 2.67 | 0.78 | — | 0.010 | 2.38 | 18.90 | — | — | 24.4 |
| | ASTM A439 Type D-2 | 2.59 | 2.52 | 0.85 | 0.009 | — | 2.20 | 19.00 | — | — | 43.4 |
| | ASTM A439 Type D-3 | 2.45 | 2.79 | 0.91 | 0.025 | — | 2.55 | 29.46 | — | — | 42.5 |
| | ASTM A439 Type D-4 | 2.40 | 5.58 | 0.88 | 0.024 | — | 4.58 | 29.90 | — | — | 42.2 |
| | ISO draft proposal S—NiMn 137 | 2.74 | 2.81 | 6.69 | 0.026 | — | 0.15 | 13.57 | — | — | 42.9 |
| Ferritic cast iron | JIS FC20 | 3.53 | 2.23 | 0.41 | 0.062 | 0.141 | — | — | — | — | 29.9 |
| | JIS FCD45 | 3.26 | 2.49 | 0.76 | 0.047 | 0.013 | — | — | — | — | 48.8 |
| | ES51F | 3.09 | 2.76 | 0.48 | 0.054 | 0.067 | 1.17 | 0.13 | — | — | 27.2 |
| | ES51 | 3.14 | 3.77 | 0.67 | 0.064 | 0.026 | 1.14 | 0.09 | — | — | 61.2 |
| Austenitic stainless steel | JIS SCS 14 | 0.06 | 1.08 | 1.13 | 0.021 | 0.018 | 19.10 | 10.84 | — | 2.21 | 48.2 |

TABLE 2

| | Materials | SCC Test Results (Mean of two runs) Rupture time (h) 33° C., 7% NaCl | 25° C., 3% NaCl | 25° C., 1% NaCl | 25° C., natural seawater |
|---|---|---|---|---|---|
| Austenitic cast iron | ASTM A436 Type 1 | 2.8 | — | — | — |
| | ASTM A436 Type 2 | 3.5 | 4.5 | 5.2 | 4.3 |
| | ASTM A439 Type D-2 | 135 | 201 | 251 | 187 |
| | ASTM A439 Type D-3 | 660 | — | — | — |
| | ASTM A439 Type D-4 | 520 | — | — | — |
| | ISO draft proposal S—NiMn 137 | 73 | — | — | — |
| Ferritic cast iron | JIS FC20 | | — | — | — |
| | JIS FCD45 | | — | — | — |
| | ES51F | no crack at 2000 hrs | — | — | — |
| | ES51 | | — | — | — |
| Austenitic stainless steel | JIS SCS 14 | | — | — | — |

As one can see from Table 2, all samples of the austentic cast iron failed in the test period although the applied stress was such that the samples would not fail in the atmosphere. This was obviously the result of the SCC that was caused by the interaction of the corrosive attack of the aqueous NaCl solutions and the applied stress. Type 2 and Type D-2 also developed SCC in the 3% NaCl, 1% NaCl and natural seawater at 25° C. From these results, one can readily see that SCC would occur in austenitic cast iron whether it is submerged in concentrated or diluted seawater. The ferritic cast iron species, JIS FC20, JIS FCD45, ES51F and ES51, as well as the austenitic stainless steel JIS SCS 14 did not fail in a 2,000-hour period and not a single tiny crack developed in the test pieces.

The above observation that austenitic cast iron develops SCC in salt water in the vicinity of ordinary temperatures whereas ferritic cast iron and austenitic stainless steel are free from such phenomenon was first discovered by the present inventors. It was quite surprising and, in conflict with metallurgical common sense to find that SCC should occur in austenitic cast iron submerged in salt water at ordinary temperatures or in its vicinity.

In order to further study the behavior of SCC in austenitic cast iron, samples of Type 2 and Type D-2 were checked for the relationship between applied stress and rupture time using test pieces with a diameter of 12.5 mm. This diameter was greater than that of the samples used in the test conducted to obtain the data shown in Tables 1 and 2. The reason for selecting such increased diameter was that it was necessary to obtain data that would be applicable to large-size equipment such as large pumps in consideration of the "size effect", i.e., the fact that larger diameters prolong the rupture time. The test was conducted in 7% NaCl at 33° C., and the test method was the same as used for obtaining the data shown in Tables 1 and 2.

The test results are shown in FIG. 1, from which one can see that both Type 2 and Type D-2 failed in shorter periods under increasing stresses. Type 2 failed at 2,000 hours under a stress of 5 kgf/mm$^2$ which was only 20% of its tensile strength whereas Type D-2 failed at 7,000 hours under a stress of 10 kgf/mm$^2$ which was 23% of its tensile strength. Surprisingly enough, SCC occurred in austenitic cast iron even under very low stress, suggesting the possibility that machines or machine parts made of austenitic cast iron would fail during service in salt water.

Therefore, it has been found that even austenitic cast iron cannot be safely used in salt water.

The present inventors made various studies to improve the SCC resistance of austenitic cast iron in salt water, and found that increasing the Ni content of austenitic cast iron is very effective for this purpose. The effectiveness of increasing the Ni content in austenitic stainless steel has already been described in literature, but it has been entirely unknown that austenitic cast iron is sensitive to SCC when it is submerged in salt water at temperatures close to ordinary temperatures. This fact was found for the first time by the present inventors, who also confirmed by experiment the effectiveness of increasing the Ni content in austenitic cast iron for the purpose of improving its resistance to SCC.

The experiments conducted to examine the effectiveness of increased Ni content against the SCC of austenitic cast iron are described below. The chemical compositions of the austenitic cast iron species used in the experiments are shown in Table 3.

TABLE 3

| Symbol | Chemical composition wt % C | Si | Mn | P | Cr | Ni | Tensile strength kgf/mm² |
|---|---|---|---|---|---|---|---|
| A | 2.71 | 2.81 | 6.72 | 0.025 | 1.88 | 13.52 | 42.8 |
| B | 2.59 | 2.52 | 0.85 | 0.009 | 2.20 | 19.00 | 42.0 |
| C | 2.75 | 2.52 | 0.90 | 0.026 | 2.30 | 21.85 | 43.3 |
| D | 2.86 | 2.85 | 0.91 | 0.024 | 2.25 | 24.13 | 42.9 |
| E | 2.66 | 2.63 | 0.87 | 0.022 | 2.24 | 25.77 | 42.2 |
| F | 2.58 | 2.72 | 0.85 | 0.023 | 2.28 | 27.82 | 41.9 |
| G | 2.44 | 2.87 | 0.91 | 0.026 | 2.34 | 29.46 | 42.3 |

Seven specimens of austenitic cast iron with their Ni contents varying from 13.52% to 29.46% were used, and except for specimen A, the proportions of the other components were almost the same. Specimen A contained Ni in an amount as small as 13.52% and in order to ensure that it would have an austenitic structure, the content of Mn in specimen A was increased to 6.72%.

Tension tests were conducted by applying 80% of the tensile strength of the respective samples to the test pieces (5 mmϕ) submerged in 7% NaCl at 33° C. The results are shown in FIG. 2 in terms of mean of two runs conducted under the same condition.

Figure 2:
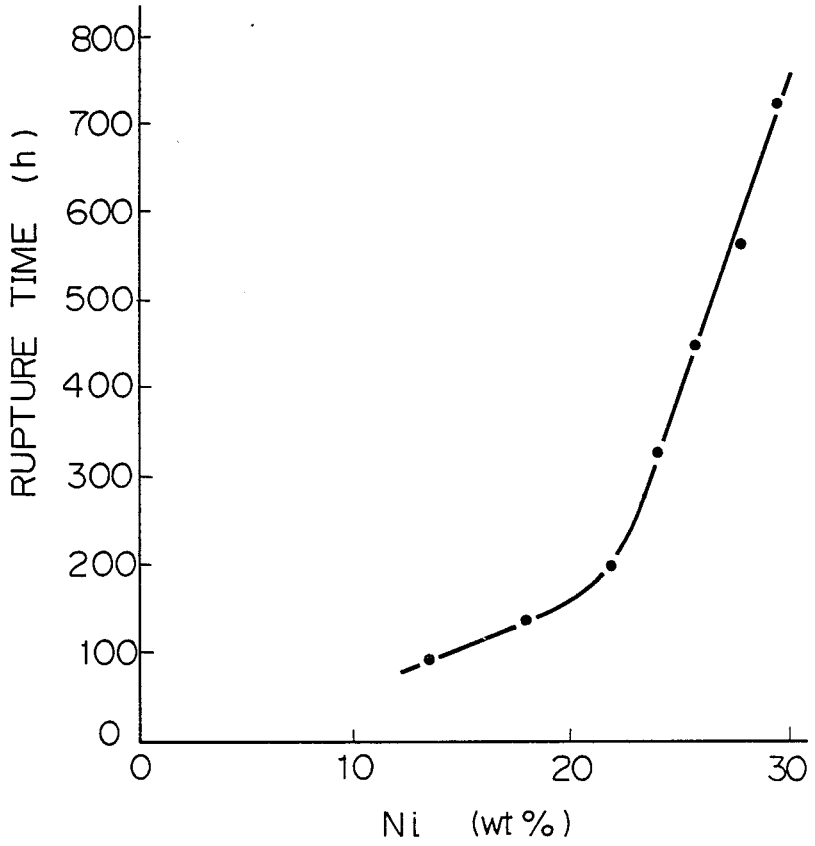
FIG. 2 shows a Ni content vs. rupture time characteristic curve for austenitic cast iron submerged in 7% NaCl solution at 33° C.

As one can see from FIG. 2, it is obvious that increasing the Ni content of austenitic cast iron is effective in extending its life, or the period for which is withstands without stress corrosion cracking. Particularly good results are attained by adding at least 24% of Ni.

The austenitic cast iron of the present invention has been accomplished on the basis of the above findings, and is characterized by the following composition:

| | |
|---|---|
| C | ≦3.00% |
| Si | 1.00–3.00% |
| Mn | ≦1.5% |
| P | ≦0.08% |
| Ni | >24.28% |
| Cr | ≦5.5% |
| Fe | balance, |

with graphite present in the form of spheroids or nodules.

The criticality of the amount of each of the components defined above is described below.

If more than 3% of carbon is contained, the cast iron becomes brittle, and therefore, the upper limit of carbon is 3%. The cast iron containing less than 1% of Si has a tendency to contain an increased amount of cementite, and therefore, silicon must be contained in an amount of at least 1%. But if more than 3% of Si is present, the resistance to the SCC is reduced.

The experiments conducted to examine the influence of the addition of Si are described below.

SCC tests were conducted with two samples, cast iron B containing 2.52% of Si and cast iron H containing 6.03% of Si. The chemical compositions of the specimens are shown in Table 4.

TABLE 4

| | C | Si | Mn | P | Cr | Ni | Tensile strength kgf/mm² |
|---|---|---|---|---|---|---|---|
| B | 2.59 | 2.52 | 0.85 | 0.009 | 2.20 | 19.00 | 43.4 |
| H | 2.32 | 6.03 | 0.81 | 0.022 | 2.02 | 20.03 | 50.2 |

Tension tests were conducted by applying a tensile stress of 30 kgf/mm² to the test pieces (5 mmϕ) submerged in 7% NaCl at 33° C. The cast iron B failed 304 hours, whereas the cast iron H failed after 52 hours in spite of its higher rupture stress than that of the cast iron B. Therefore, it was found that increasing the Si content resulted in a reduced resistance to SCC of the cast iron.

Manganese is effective for the stabilization of the austenitic structure, deoxidation, desulfurization, and may be added to the cast iron as required. However, incorporating more than 1.5% of Mn is not necessary except in the case where applications at cryogenic temperatures are contemplated. Therefore, the upper limit of Mn is set at 1.5%.

On the other hand, if the stabilization of austenitic structure by Mn is not necessary, or if special provisions are made for deoxidation or desulfurization, the incorporation of Mn is not necessary and therefore, the lower limit for Mn is not particularly specified.

As the P content is increased, the solubility of C is decreased and the chance of carbide formation is increased, producing a product having unsatisfactory mechnical properties. Therefore, the upper limit for P is 0.08%.

Cr is an element effective for providing high resistance to heat, wear and acids, but the lower limit for Cr is not particularly specified since the addition of Cr is not always necessary if austenitic cast iron is used in neutral salt water containing no abrasive substances. On the other hand, the Cr in cast iron strongly inhibits the formation of graphite and will increase the tendency of cementite formation by its stabilization. Additionally, Cr greatly promotes the tendency of the formation of chromium carbides, making it impossible to provide a sound structure. Therefore, the upper limit for Cr is set at 5.5%.

The experiments conducted to examine the influence of Cr on SCC are described hereunder. The SCC tests were conducted with two specimens, cast iron G containing 2.34% of Cr and cast iron I containing 4.21% of Cr.

The chemical compositions of the test specimens are shown in Table 5.

TABLE 5

| | C | Si | Mn | P | Cr | Ni | Tensile strength kgf/mm² |
|---|---|---|---|---|---|---|---|
| G | 2.44 | 2.87 | 0.91 | 0.026 | 2.34 | 29.46 | 42.3 |
| I | 2.40 | 2.62 | 0.82 | 0.024 | 4.34 | 29.91 | 40.5 |

A tension test was conducted by applying a tensile stress of 30 kgf/mm² to the test pieces (5 mmϕ) submerged in 7% NaCl at 33° C. The cast iron G failed 2,100 hours and the cast iron I failed after 2,250 hours, with no great difference found between the specimens.

Chromium has no significant effects on SCC itself and its upper limit is set at 5.5% for the practical reasons already mentioned that are associated with the manufacture of austenitic cast iron.

Ni is the most effective component for improving the resistance to SCC, and particularly good results achieved by addition of at least 24% of Ni. Therefore, the lower limit for the addition of Ni is set at 24%. The increased addition of Ni is effective in improving the resistance to SCC, but this increases the materials cost and is not economically desired. Therefore, the upper limit for Ni is about 28%.

As described above, machines or machine parts made of the austenitic cast iron in accordance with the present invention have high resistance to SCC, and can be used most effectively as salt water resisting materials.

What is claimed is:

1. A method for improving the resistance to stress corrosion cracking of machines and machine parts made of austenitic cast iron which are in contact with salt water and operated under conditions of stress, said method comprising contacting salt water with a machine or machine part made of austenitic cast iron with graphite in the form of spheroids or nodules, said cast iron consisting essentially of not more than 3% by weight C, 1–3% Si, not more than 1.5% Mn, not more than 0.08% P, more than 24% and not more than 28% Ni, not more than 5.5% Cr and the balance Fe, under conditions which cause stress in said machine or machine part.

2. The method of claim 1, wherein said machine is a pump.

3. In an improved method of pumping salt water with a pump to minimize stress corrosion of said pump, the improvement comprising that the portions of said pump in contact with said salt water are made of austenitic cast iron with graphite in the form of spheroids or nodules, said cast iron consisting essentially of not more than 3% by weight C, 1–3% Si, not more than 1.5% Mn, not more than 0.08% P, more than 24% and not more than 28% Ni, not more than 5.5% Cr and the balance Fe.

* * * * *